US006435253B1

(12) United States Patent
Steeves et al.

(10) Patent No.: US 6,435,253 B1
(45) Date of Patent: Aug. 20, 2002

(54) EXTENDIBLE PARTITION ASSEMBLY

(75) Inventors: Robert E. Steeves; Dale R. Marshall, both of Calgary (CA)

(73) Assignee: Smed International, Inc., Calgary (CA)

( * ) Notice: Subject to any disclaimer, the term of this patent is extended or adjusted under 35 U.S.C. 154(b) by 0 days.

(21) Appl. No.: 09/796,020

(22) Filed: Feb. 28, 2001

(51) Int. Cl.[7] ..... A47G 5/00
(52) U.S. Cl. ..... 160/135; 160/222
(58) Field of Search ..... 160/222, 226, 160/227, 228, 202, 211, 216, 223, 135, 351; 52/239

(56) References Cited

U.S. PATENT DOCUMENTS 3,750,737 A * 8/1973 Woodward ..... 160/202
5,417,272 A * 5/1995 Marlowe et al. ..... 160/202
5,675,946 A 10/1997 Verbeek et al.
5,832,980 A * 11/1998 Cianciolo ..... 160/197
5,873,205 A 2/1999 Hanlon et al.
5,908,064 A * 6/1999 Bruce ..... 160/202
6,068,041 A 5/2000 Miles et al.

* cited by examiner

*Primary Examiner*—David M. Purol
(74) *Attorney, Agent, or Firm*—Flynn, Thiel, Boutell & Tanis, P.C.

(57) ABSTRACT

An arrangement employing first and second upright partitions positioned in laterally overlapping relationship and connected along upper and lower edges by a slide arrangement permitting one partition to be manually moved lengthwise thereof. The slide arrangement includes slide rails fixed to each partition adjacent upper and lower edges thereof. Slide brackets are fixed adjacent upper and lower edges of each partition and have sidewardly cantilevered portions which slidably engage within channels of the slide rail on the laterally adjacent partition. Removable top caps mount over the upper slide rails.

14 Claims, 10 Drawing Sheets

FIG. 1
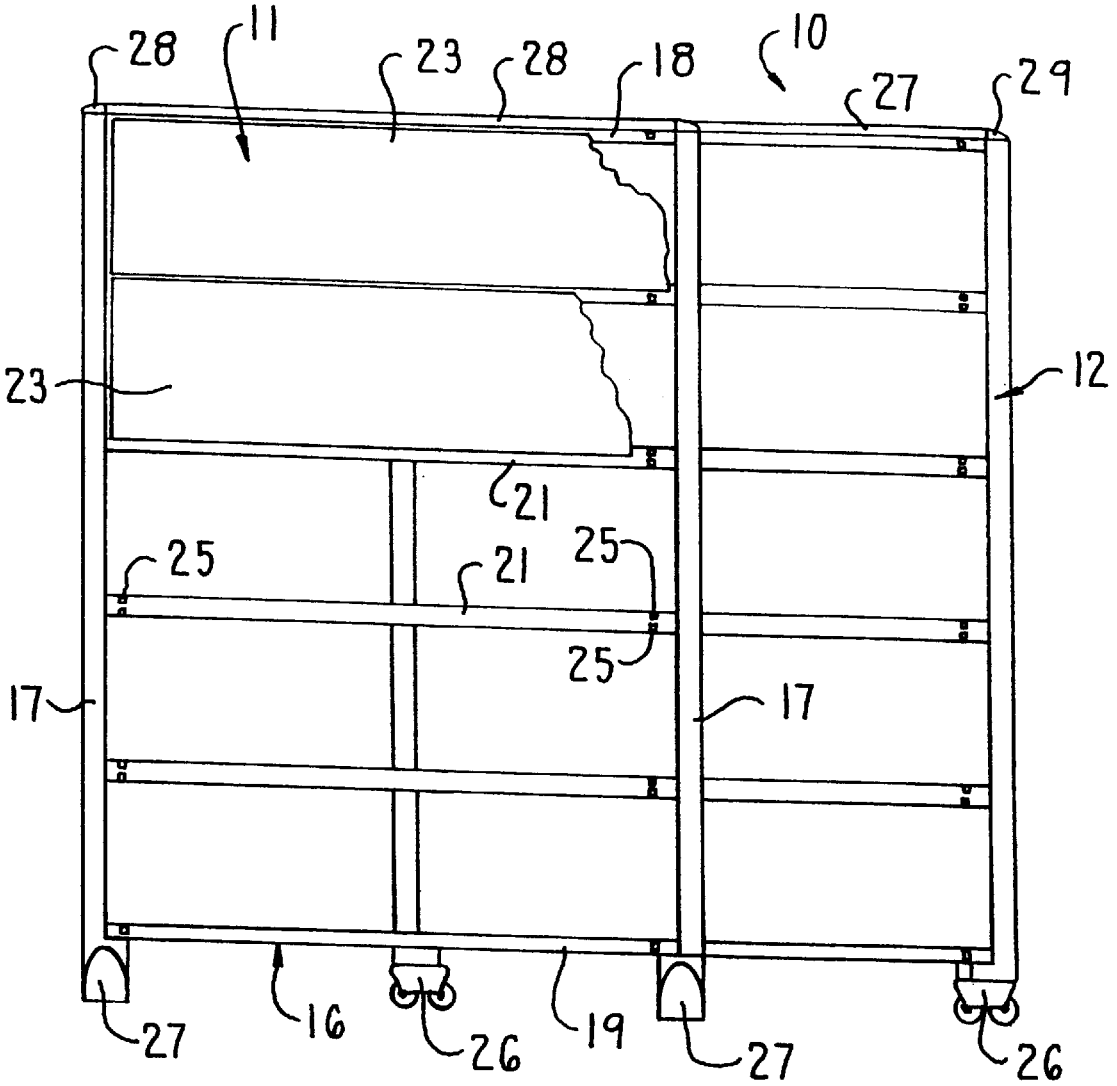
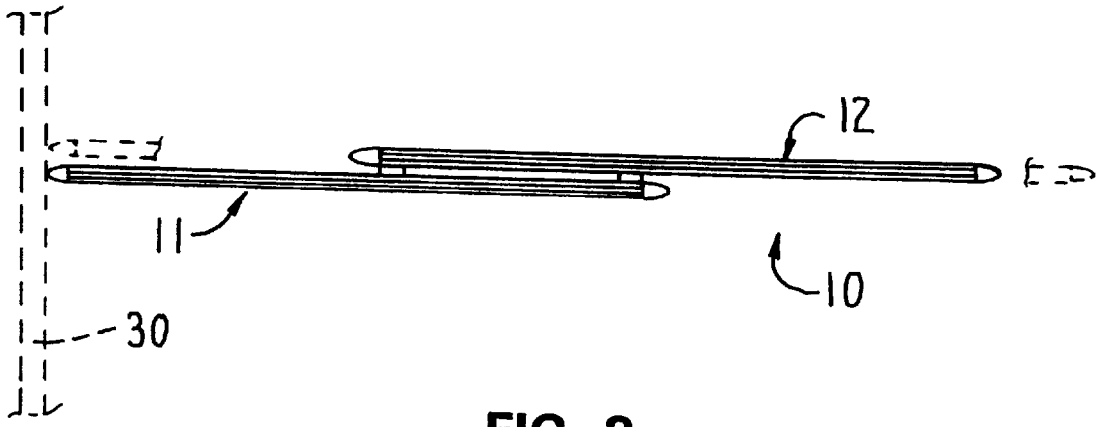
FIG. 2

EXTENDIBLE PARTITION ASSEMBLY

FIELD OF THE INVENTION

This invention relates to an upright partition assembly usable for at least partially defining workstations and, in particular, to an extendible partition assembly wherein first and second upright partitions are slidably joined in the lengthwise extent and positioned in adjacent laterally disposed relationship so that one partition can be moved relative to the other partition from a sideward overlapping disposition to increase the length of the partition assembly.

BACKGROUND OF THE INVENTION

In a typical office environment, large open areas are frequently subdivided into workspaces by space-dividing wall panels or partitions which are supported on the floor and project upwardly therefrom. The wall panels are typically of less than floor-to-ceiling height, and frequently employ a plurality of panels appropriately interconnected to define an upright wall arrangement. The panels can typically be disassembled to permit rearrangement if desired. In many office environments, however, there exists a need to temporarily provide larger workspaces or areas, such as for meetings involving a larger number of people than can be comfortably accommodated in a typical workspace, or to provide greater openness to a workspace, or conversely there is a need to temporarily provide greater closure or more privacy in the workspace including effecting closure of a doorway or walkway into the workspace.

Attempts to improve the usability of interior space-dividing walls or partitions, particularly with respect to the needs discussed above, have involved providing existing wall panels with a door panel supported thereon which can be rollingly moved into an extended position for closing off a walkway or doorway, although known panels of this type have often involved rather complex structures particularly with respect to the mounting hardware utilized to support the door panel on an adjacent wall panel. Other prior attempts have involved providing multiple panels or partitions in laterally adjacent or overlapping relationship and slidably connected in the lengthwise direction so as to permit the wall to be extended and contracted, but such arrangements have often involved interconnection of laterally adjacent wall panels by visible top connectors which detrimentally impact the appearance and aesthetics of the wall arrangement.

Examples of prior constructions are illustrated by U.S. Pat. Nos. 6,068,041, 5,873,205 and 5,675,946.

Accordingly, this invention relates to an extendible partition assembly wherein a first upright partition is stored in laterally adjacent and overlapping relationship to a second partition, with the first partition being easily manually movable in a lengthwise direction to permit lengthening of the wall defined by the partition assembly or to permit closure of a walkway to thereby provide increased privacy or flexibility with respect to usability of an adjacent workspace, while at the same time providing a partition assembly which has desirable aesthetics and utilizes relatively simple connecting hardware which is effectively hidden between the partitions when the assembly is extended and contracted.

SUMMARY OF THE INVENTION

The present invention is directed to an extendible partition assembly adapted for disposition in an upright manner on a floor of an office or the like, and which can be easily and efficiently extended and contracted in the lengthwise direction thereof so as to increase the length of the assembly or to effect closure of a door opening or walkway, while effectively providing control over the degree of privacy or the effective use of workspaces, and at the same time providing a partition assembly which utilizes connecting hardware between relatively movable partitions which is effectively hidden so as to provide improved aesthetics and which permits ease of operation of the movable partition while permitting utilization of hardware which is relatively inexpensive and structurally and mechanically simple.

More specifically, the present invention comprises an extendible partition arrangement employing at least first and second upright partitions which are positionable in laterally adjacent overlapping relationship and are connected, lengthwise along upper and lower edges thereof, by a slide arrangement permitting one of the partitions to be easily manually moved in the lengthwise direction thereof from a collapsed or overlapping position to an extended position wherein it projects outwardly a substantial distance beyond the other partition. The slide arrangement includes elongate slide rails which are fixed to the frame of each partition adjacent upper and lower edges thereof. The slide rail has a pair of guide channels formed therein and extending lengthwise therealong, which guide channels are disposed adjacent opposite sides of the partition and open generally sidewardly of the respective partition A slide bracket is fixed adjacent upper and lower edges of each partition adjacent one end thereof. Each slide bracket has a sidewardly cantilevered portion which is slidably engaged within one of the channels of the slide rail on the laterally adjacent partition. The partitions are preferably provided with removable top caps which are disposed above and cover the respective upper slide rail and upper slide bracket. Only a portion of the cantilevered part of the slide bracket, namely the portion which projects sidewardly between the adjacent partitions, is exposed, and this exposed portion is effectively hidden between the partitions since the upper brackets extend transversely between narrow sidewardly-opening access slots which are defined below the partition top caps and extend lengthwise along the partitions for accessing the channels in the slide rails.

In the extendible partition assembly of the present invention, as aforesaid, and in accordance with a preferred embodiment of the invention, the adjacent partitions which are relatively longitudinally movable are provided with identical top slide rails and top slide brackets, and in each of the partitions the bottom bracket and bottom slide rail are preferably substantially identical to the respective top bracket and top slide rail except for reverse vertical orientation thereof.

The present invention, together with objects and advantages thereof, will be apparent upon study of the following description and accompanying drawings.

BRIEF DESCRIPTION OF THE DRAWINGS

In the drawings:

FIG. 1 is a fragmentary side elevational view of an extendible partition assembly according to the present invention;

FIG. 2 is a top view of the assembly illustrated in FIG. 1;

Figure 3:
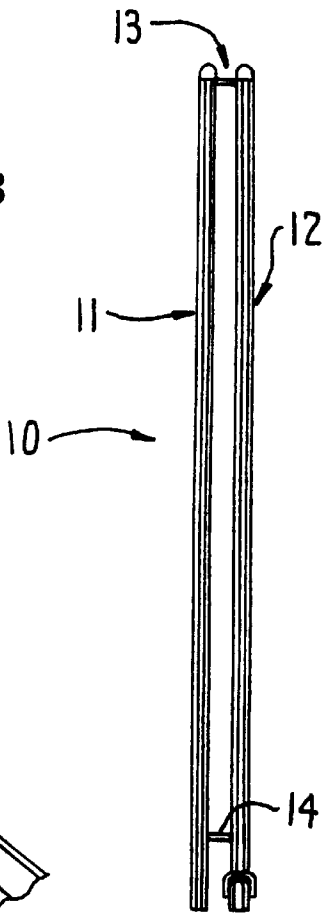
FIG. 3 is an end elevational view taken from the right side of FIG. 1.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will respectively refer to directions toward and away from the geometric center of the arrangement and designated parts thereof. Said terminology will include the words specifically mentioned, derivatives thereof, and words of similar import.

DETAILED DESCRIPTION

Referring to FIGS. 1–3, there is illustrated an extendible partition assembly 10 according to the present invention. The assembly 10 includes a first or base partition 11 which cooperates with a second or movable partition 12. The partitions 11 and 12 are of generally similar construction and are positionable in laterally adjacent side-by-side relationship, with the partitions 11 and 12 being connected together adjacent their upper ends by a top sliding connector arrangement 13, and a similar bottom sliding connector arrangement 14 being provided for connecting the lower edges of the partitions, whereby the second partition 12 is movable in the lengthwise direction thereof relative to the first partition 11.

FIGS. 1 and 2 illustrate the movable partition 12 in a partially extended position. That is, the movable partition 12 has about one-half the length thereof disposed in sideward overlapping relationship to the base partition 11, whereas the other half of the movable partition 12 is extended outwardly beyond the adjacent upright end of the base partition 11. The movable partition 12 can be disposed in a storage or collapsed position wherein it substantially wholly sidewardly overlaps the base partition 11, as diagrammatically indicated by dotted lines in FIG. 2. Alternatively, the moving partition 12 can be moved into a fully extended position wherein the amount of overlap between partitions 11 and 12 is a minimum, and thus a majority of the length of the movable partition 12 projects lengthwise beyond the adjacent end of the base partition 11. Movement toward the fully extended or opened position of the partition assembly is indicated by the rightward dotted line position of partition 12 in FIG. 2.

Each upright partition 11 and 12 includes a generally identical upright rigid frame 16 defined by generally parallel and vertically extending end rails or uprights 17 which are rigidly joined adjacent upper and lower ends thereof by respective top and bottom cross beams 18 and 19, the latter extending generally horizontally and having the ends thereof rigidly joined to the respective uprights 17. The frame 16 in the illustrated embodiment also includes a plurality of intermediate beams 21 which extend horizontally between and have the ends thereof rigidly connected to the uprights 17, with these intermediate beams 21 being disposed in vertically spaced relation between the top and bottom cross beams. The cross beams 18, 19 and 21 in the illustrated embodiment are formed as hollow tubes having a generally rectangular cross section, with the width of the tubes being substantially less than the width of the uprights 17. The uprights 17, on the inner surfaces thereof, are provided with grooves 22 (FIG. 4) therein which extend vertically of the upright generally along the upright central plane thereof, and the ends of the cross beams 18, 19 and 21 project into these grooves 22 for rigid securement to the uprights. While not illustrated, the cross beams and uprights can be rigidly joined in any conventional manner, such as by brackets or welding.

The narrower width of the cross beans 18, 19 and 21 relative to the width of the uprights 17 results in shallow pockets or recesses defined generally coextensively over opposite sides of the upright frame 16, which pockets accommodate therein cover pads 23 or other appropriate exterior tiles or the like for defining the exterior side surfaces of the partition. In the illustrated embodiment a plurality of removable cover pads 23 are disposed for association with each side pocket of the frame, with the cover pads 23 having spring clips 24 (FIG. 5) projecting rearwardly therefrom for engagement with openings 25 formed in the cross beams to permit the cover pads to be releasably but securely engaged with the frame.

The overall construction of the partition frame, as well as the covering of the frame with removable cover pads, is disclosed in copending application Ser. No. 60/210,819, filed Jun. 9, 2000, owned by the Assignee hereof, and the disclosure thereof is incorporated herein by reference. It will be appreciated, however, that the partition frame as well as the cover pads can be modified in accordance with many well-known constructional variations without departing from the invention as described herein.

Figure 7:
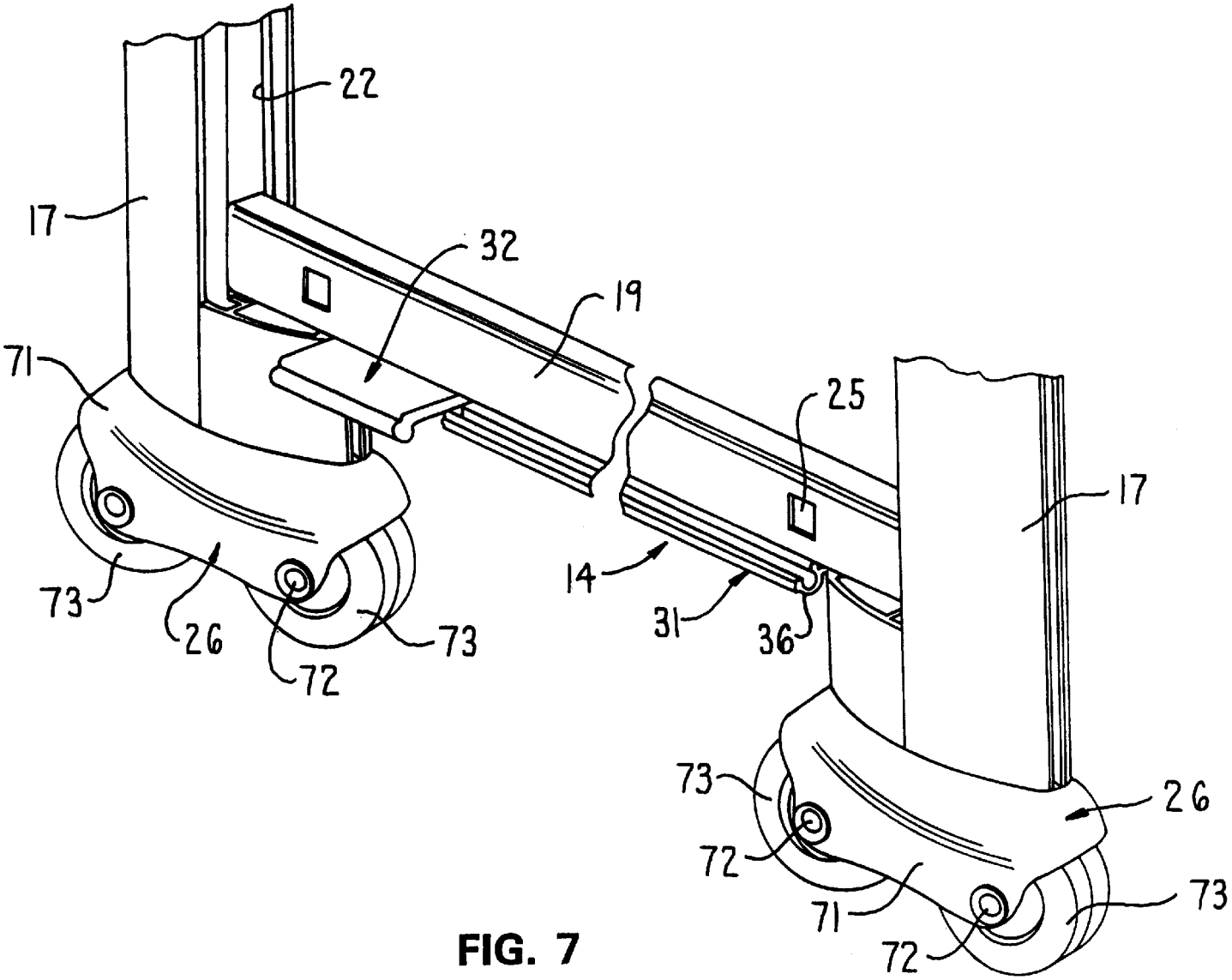
FIG. 7 is a fragmentary perspective view which illustrates the bottom of the partition frame and the connecting slide structure associated therewith, the side covers being removed from the frame for clarity of illustration.

The extendible partition assembly 10 in the illustrated embodiment has the movable partition 12 provided with roller units 26 associated with the lower ends of the uprights 17. These roller units 26 are disposed in supportive and rolling engagement with the floor. The roller units 26 each include a shroud 71 (FIG. 7) fixed to the lower end of the upright 17. The shroud 71 mounts thereon a pair of parallel horizontal axles 72 which support a pair of wheels 73 aligned in the lengthwise direction of the partition and rotatable generally within the upright plane thereof.

The base partition 11 in the illustrated embodiment has support feet 27 secured to the lower ends of the uprights 17, which support feet supportingly engage the floor to maintain the base partition 11 in an upright position. It will be appreciated that numerous other types of support feet, or in the alternative roller units, can be provided on the lower ends of the uprights 17 associated with the base panel 11. Further, the base partition 11 will frequently be positioned so that one end thereof, namely the leftward end in FIGS. 1 and 2, will be positioned closely adjacent a further upright space-dividing partition or wall, such as the wall 30 indicated diagrammatically by dotted lines in FIG. 2. In some instances it may be necessary or desirable to fixedly connect the leftward edge of base partition 11 to the adjacent wall 30, and such can be accomplished utilizing numerous bracket or connecting structures. One example of a connecting bracket structure is illustrated in aforementioned application Ser. No. 60/210,819.

Figure 11:
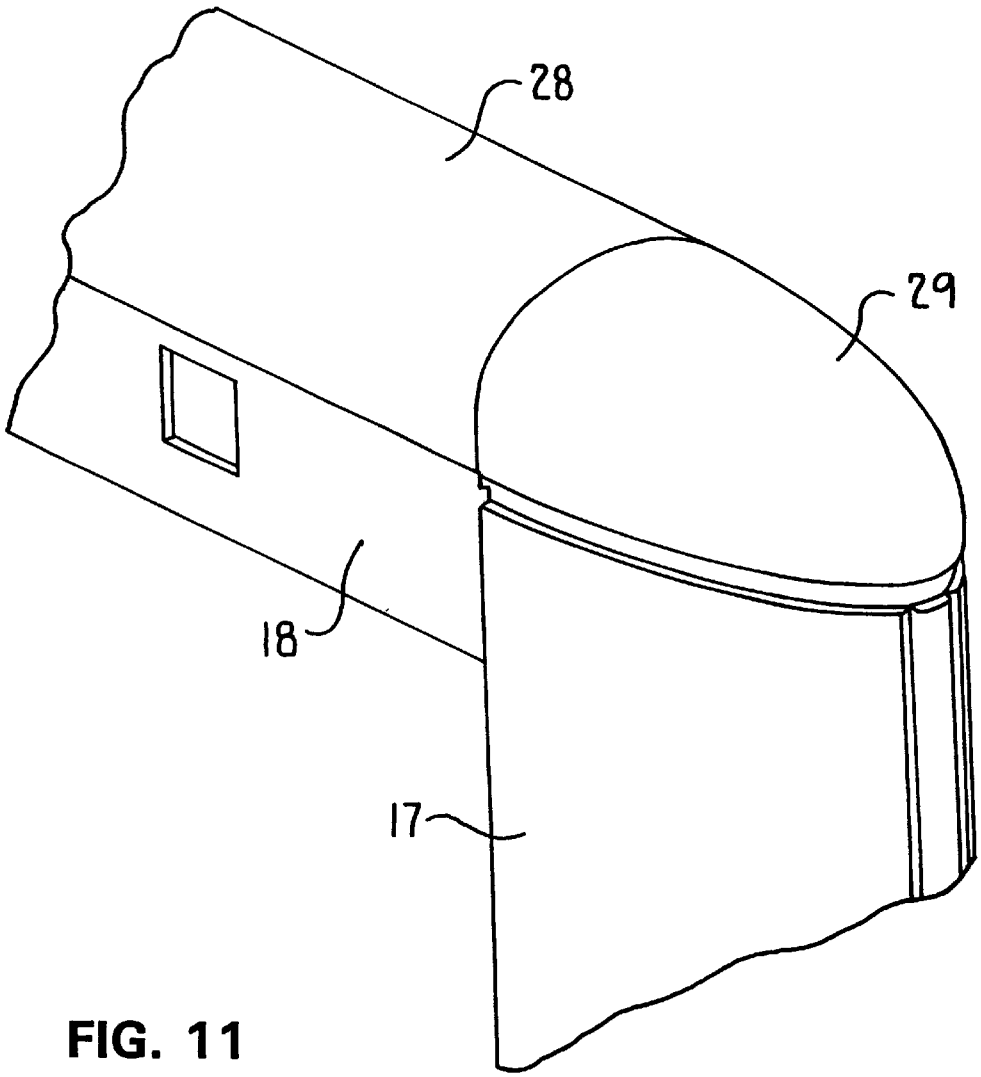
FIG. 11 is an enlarged, fragmentary perspective view showing one corner of the partition frame having the top and end caps mounted on the frame.

Each partition 11, 12 also mounts thereon a top cap 28 which is positioned above and extends lengthwise along the length of the top cross beam 18. Top cap 28 at opposite ends effectively abuts a pair of corner caps 29 which generally align with the top cap and are positioned at the upper ends of the uprights 17. The top and corner caps 28 and 29 and their association with the partition frame are also illustrated in FIG. 11.

Considering now the top sliding connecting arrangement 13, it includes a top slide rail 31 (FIGS. 4–6) which is supported on and fixed to the upper surface of the top cross beam 18 of each partition 11 and 12 and extends longitudinally throughout substantially the entire length thereof. This top slide rail 31 includes an elongate rail section 31A (FIG. 4) having one end thereof positioned directly adjacent one of the uprights 17 and elongated so as to extend over a majority of the length of the top cross beam but terminating short of the other upright 17. The top slide rail 31 includes a further top rail section 31B which is of short length and extends inwardly from the other upright 17 but terminates short of the opposed end of the long slide rail section 31A so as to define a small gap between the opposed ends of the aligned rail sections 31A and 31B. This gap accommodates therein a slide bracket 32 which is supported on and fixedly secured to the upper surface of the top cross beam 18, and which projects sidewardly toward the other partition of the assembly for slidable engagement with the top slide rail 31 associated with said other partition.

Figure 8:
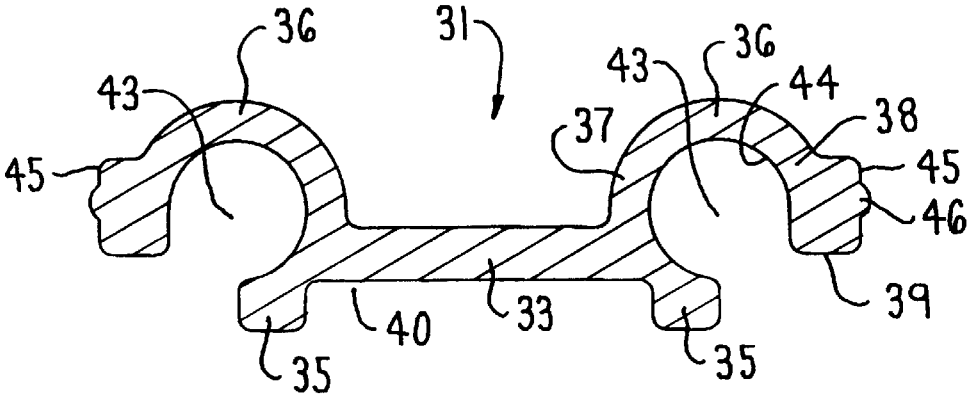
FIG. 8 is an enlarged cross-sectional view of the slide rail.

The top slide rail 31 has a substantially uniform cross section throughout the elongated length thereof and, when viewed in cross section (FIGS. 5 and 8) has a flat or plate-like center portion 33 which is disposed in supportive engagement with the top wall of the top cross beam 18 and is fixed thereto, such as by a plurality of lengthwise-spaced fasteners 34 such as screws. The plate-like center portion 33, adjacent opposite longitudinally extending edges thereof, is provided with downwardly cantilevered flanges 35 which extend lengthwise along the slide rail and project downwardly through only a small extent. These side flanges 35 are sidewardly spaced apart by a distance which closely approximates or only slightly exceeds the width of the top cross beam 18, thereby defining in cooperation with the part 33 a shallow downward-opening channel 40 so that the slide rail 31 properly seats (i.e. nests) on the top cross beam 18.

The plate-like center portion 33 of the top slide rail 31, adjacent opposite longitudinally extending side edges thereof, is fixedly joined to a pair of parallel channel parts 36 which extend longitudinally throughout the length of the top slide rail. These channel parts 36 project upwardly and outwardly relative to the flat center portion 33 and have a generally U-shaped cross section disposed so as to open downwardly. The channel parts 36, as they extend lengthwise along the top cross beam 18, are accessible generally from opposite sides of the top cross beam 18.

Each channel part 36 is defined by an inner leg 37 which is joined to and projects upwardly from the flat center portion 33 adjacent a respective longitudinally extending edge thereof, with the upwardly projecting inner leg 37 being positioned slightly inwardly relative to the respectively adjacent bottom flange 35. The channel part 36 also has an outer leg 38 which terminates in a lower free end or edge 39 which, in the illustrated embodiment, is disposed at an elevation which is normally at or above the upper surface of the top cross beam 18. The lower free edge 39 of the channel part 36 is normally disposed in vertically spaced relationship above an upper edge 41 (FIG. 5) of the exterior cover pad 23 which is disposed within the upper portion of the frame side pocket and engaged with the top cross beam 18. The vertical spacing between these opposed surfaces 39 and 41 defines a vertically narrow clearance slot 42 which opens sidewardly into the partition directly above the upper edge of the upper cover pad 23 throughout the entire length of the top cross beam 18.

The slot 42 communicates with and provides access to an interior downwardly-opening channel or groove 43 which is defined within and extends longitudinally throughout the length of the respective channel part 36. This groove 43 opens upwardly from the inner end of the access slot 42, which access slot at its inner end is closed off by the edge flange 35. The groove 43 is defined by the inner wall 44 of the channel part 36 and has a cross sectional configuration which resembles a partial circular configuration, and in fact preferably extends through an angle in excess of 180° to facilitate captivation of a part of the slide bracket 32 therein as explained hereinafter. In the illustrated embodiment, the arcuate wall 44 extends through an angle of about 270°.

Each channel part 36, on the outer leg 38 thereof, is provided with a generally flat outer side wall 45 which extends generally vertically and is elongated throughout the length of the slide rail. This outer side wall 45 has a small rib-like protrusion 46 which protrudes outwardly therefrom in upwardly spaced relation from the free edge 39.

Figure 9:
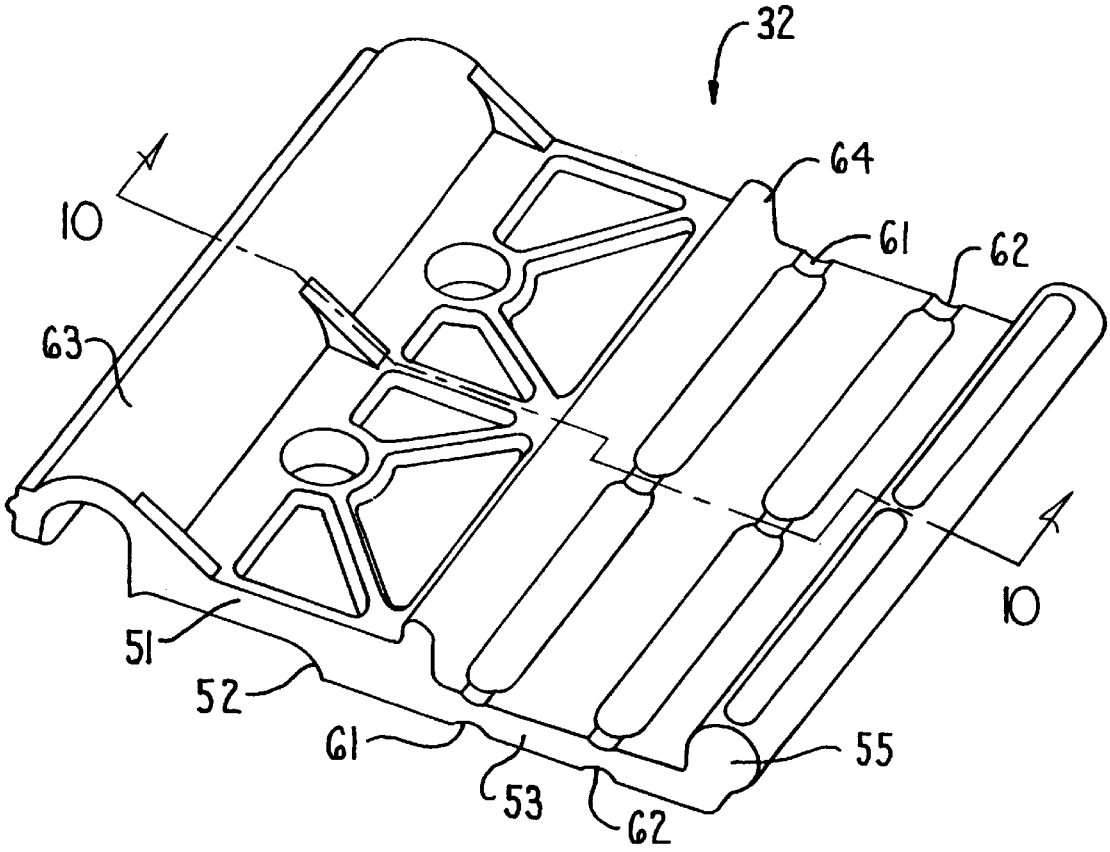
FIG. 9 is an enlarged perspective view of the slide bracket.
Figure 10:
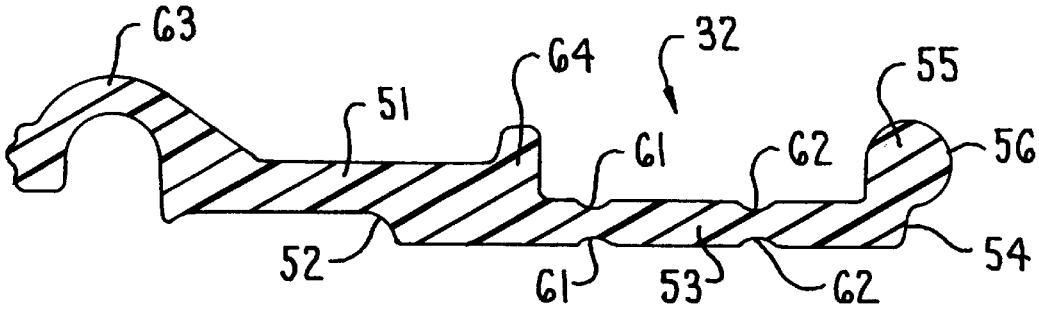
FIG. 10 is a cross-sectional view of the slide bracket taken generally along line 10—10 in FIG. 9.
Figure 12:
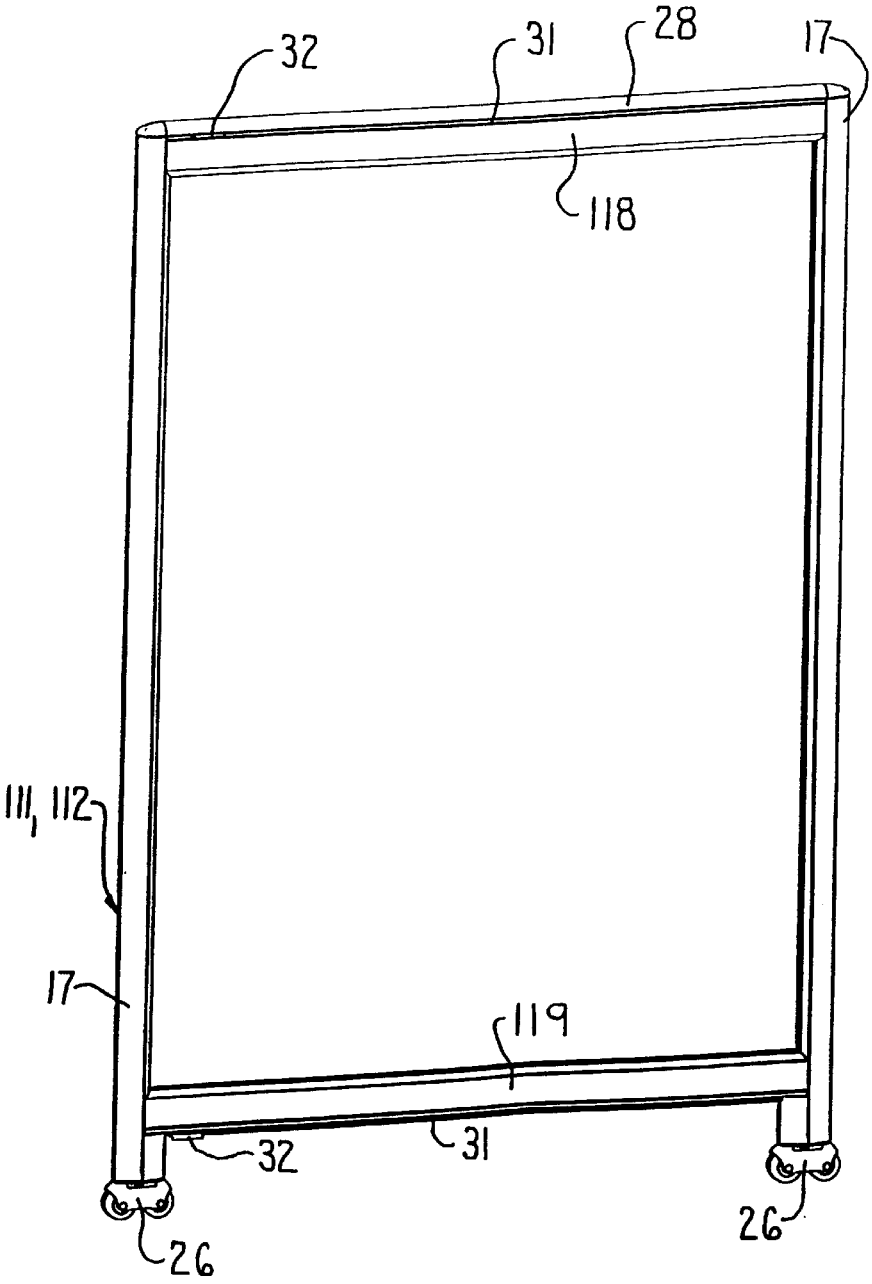
FIG. 12 is a perspective view which illustrates a modified construction of the partition.
Figure 13:
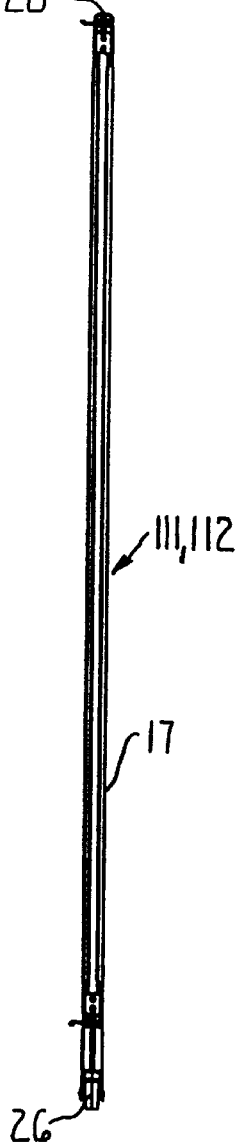
FIG. 13 is an end elevational view of the partition of FIG. 12.

Considering now the top slide bracket 32 (FIGS. 5, 9 and 10), one of which is associated with the upper edge of each partition 11, 12 adjacent one end thereof, this slide bracket 32 includes a main mounting part 51 defined generally as a flat or plate-like member having a shallow recess 52 on the underside thereof, whereby the part 51 can be positioned in supportive engagement with the upper surface of the top cross beam 18 within the gap defined between the top slide rail sections 31A and 31B. This main mounting part 51 is fixedly secured to the top cross beam 18 by appropriate fasteners such as screws 65.

The slide bracket 32 also has a generally flat or plate-like part 53 which is cantilevered transversely away from only one side of the respective partition in a direction toward the sidewardly adjacent other partition so as to span the gap therebetween. This cantilevered part 53 is offset vertically downwardly a small amount from the main mounting part 51, whereupon this cantilevered part 53 is substantially aligned with and hence projects into the access slot 42 associated with the other partition. The cantilevered part 53, adjacent the free edge 54 thereof, is provided with a slide part 55 which is elongated generally along the free edge 54 and protrudes upwardly therefrom for slidable engagement within the interior groove 43 defined by the adjacent channel part 36 on the opposed partition. The slide part 55 has a generally rounded outer surface 56 which defines part of a circle extending substantially in excess of 180° so that the slide part 55, at the lower portion where it joins to the cantilevered part 53, is of reduced width relative to the maximum width of the slide part 55 so as to be positionable in the reduced-width of the mouth defined at the lower open end of the channel part 36. The slide part 55, due to its cross sectional configuration and its elongated length, thus has a configuration similar to an elongate cylinder which along the bottom side thereof is joined to the cantilevered bracket part 53.

The cantilevered part 53 of slide bracket 32 also has a first pair of opposed grooves 61 formed in and extending across upper and lower surfaces thereof adjacent the end of the cantilevered part where it joins to the mounting part 51. These grooves 61 are disposed so that, when the slide bracket is mounted on the partition, the opposed grooves 61 define a first living hinge axis which extends horizontally in the lengthwise or longitudinal direction of the partition and is positioned closely adjacent one side surface thereof. A further pair of opposed grooves 62 are defined in and extend across upper and lower surfaces of the cantilevered part 53 adjacent the free end thereof, with these grooves 62 being generally parallel with but spaced outwardly from grooves 61 so as to be disposed more closely adjacent the cantilevered part 55. The grooves 62 define a second living hinge axis which is generally parallel with the hinge axis defined by grooves 61, except that the hinge axis defined by grooves 62 is disposed generally parallel with and extends in the horizontal lengthwise direction of the partitions closely adjacent the exterior side of the opposed partition, that is the partition with which the slide part 55 is engaged.

To more effectively close off the gap created between the ends of the slide rail sections 31A and 31B, the mounting part 51 of slide bracket 32 has, at the side thereof opposite the cantilevered part 53, a channel part 63 which generally corresponds to the channel parts 36 associated with the slide rails 31. The channel part 63 on the slide bracket 32 effectively aligns with and fills the gap defined between the channel parts associated with one side of the slide rail sections 31A and 31B. The opposite side of the slide bracket mounting part 51, namely where the mounting part 51 joins to the cantilevered part 53, is provided with an upwardly projecting rib 64 which effectively aligns with and spans the gap between the lower portions of the outer side legs 38 of the channel parts 36 associated with this side of the partition. The exterior side wall of rib 64 generally aligns with the exterior side wall 45 provided on the channel parts 36.

Figure 5:
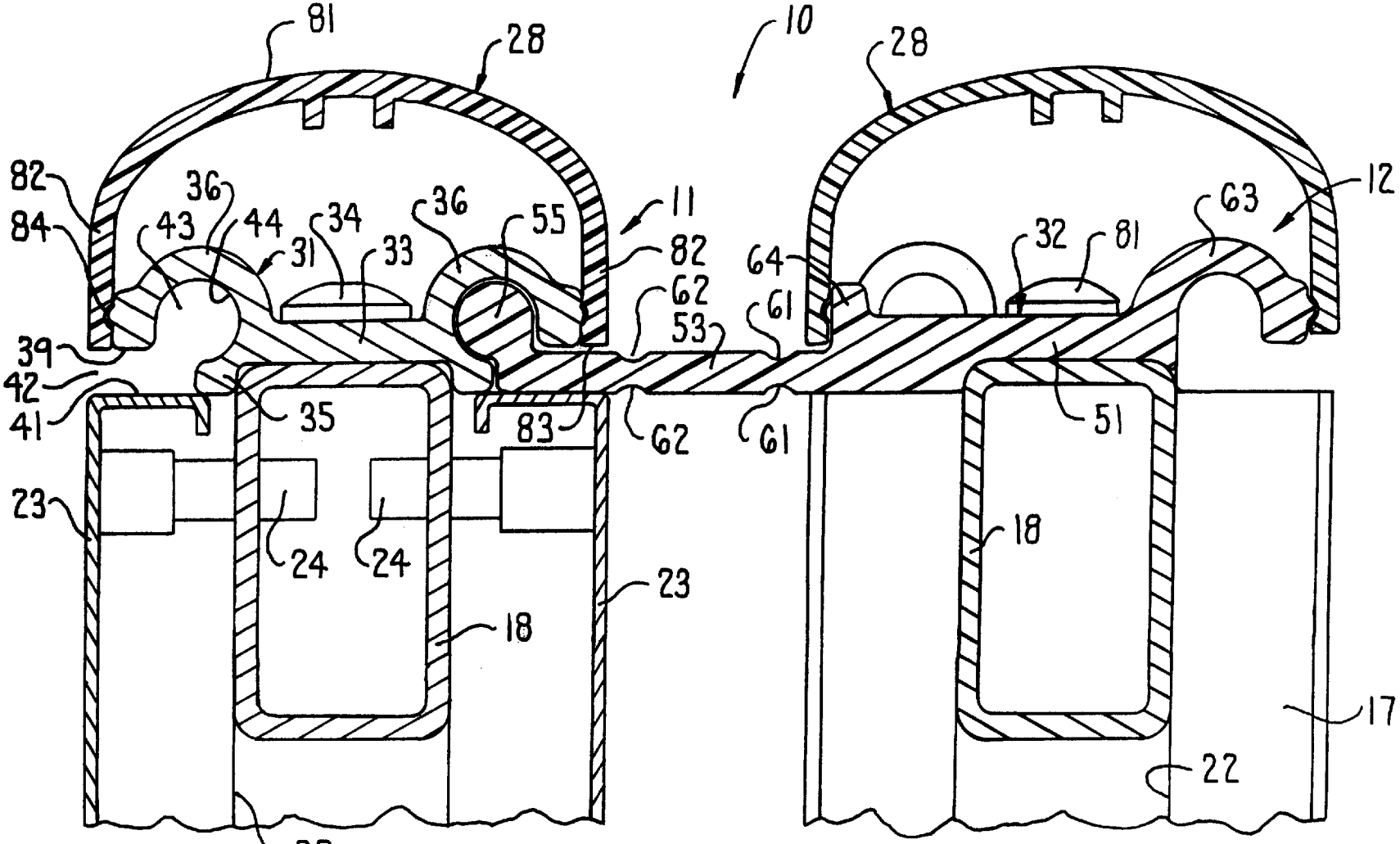
FIG. 5 is an enlarged, fragmentary sectional view taken generally along line 5—5 in FIG. 4.
Figure 6:
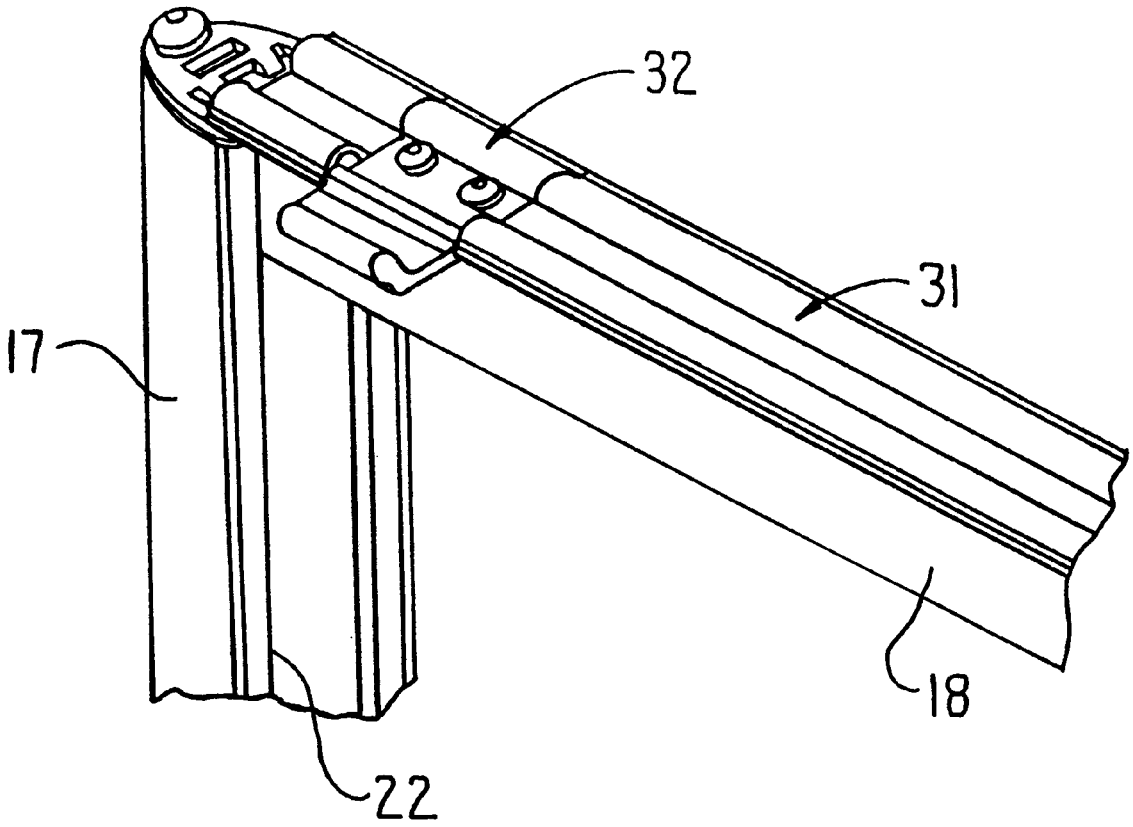
FIG. 6 is an enlarged fragmentary perspective view, showing solely one upper corner of the partition frame and the connecting slide bracket associated therewith.

The top slide rail 31 as associated with each partition 11 and 12 also functions to support the top cap 28 on the partition. Top cap 28 as shown in FIG. 5 comprises a generally downwardly-opening channel member (i.e., C or U shaped) having a generally rounded convex top wall 81 which, at opposite longitudinally-extending sides, joins to generally parallel side legs 82 which are cantilevered downwardly and terminate at lower free ends 83. The side legs 82 are sized to snugly embrace the exterior side walls 45 on the slide rail 31, and the inner surfaces of the legs 82 have, at a location spaced slightly upwardly from the free ends 83, longitudinally extending grooves 84 which matingly engage with the protruding ribs 46 associated with the side walls 45.

The top cap 28 is preferably formed of a material having substantial rigidity, for example being extruded of a plastics material, but has sufficient resiliency to allow the cantilevered side legs 82 to resiliently snap over the riblike protrusions 46 and hence snugly embrace the exterior side surfaces 45 of the slide rail 31. The engagement of the top cap side legs 82 with the exterior side walls 45 of the slide rail thus securely mount and hold the top cap 28 to the slide rail, while effectively wholly enclosing the slide rail 31, and also effecting proper positioning the top cap so that the lower free ends 83 of the side legs 82 are substantially flush with the free ends 39 defined on the outer legs of the channel parts 36. These surfaces 39 and 83 thus function to define the upper boundaries of the narrow horizontally-extending access slots 42 which extend the length of the partition along the opposite sides thereof.

Considering now the bottom sliding connector arrangement 14, it is substantially identical to the top sliding connector arrangement 13 as described above. That is, the bottom sliding connector arrangement 14 (FIG. 7) includes a slide rail 31 and a slide bracket 32 fixedly associated with the bottom cross beam 19 of each partition 11 and 12. More specifically, each partition has a slide rail 31 positioned in supportive engagement with and fixedly secured to the underside or bottom surface of the bottom cross beam 19, with the bottom slide rail 31 being reversely oriented relative to the top slide rail 31 in that the channel parts 35 of the bottom slide rail open upwardly (rather than downwardly as in the top slide rail). The bottom slide rail 31 extends from one end of the cross beam 19 and has a length corresponding to the upper slide rail section 31A, whereby the other end of the bottom slide rail terminates short of the other end of the bottom cross beam and defines a space or gap in which the bottom slide bracket 32 is accommodated. This bottom slide bracket 32 is also supportingly engaged with and fixedly secured to the underside of the bottom cross beams 19, and is oriented so that its cantilevered part projects sidewardly of the partition in the same direction as the upper slide bracket, except that the vertically protruding slide part 55 on the lower slide bracket is oriented so as to protrude downwardly (rather than upwardly as with the top slide bracket). Thus, on each of the partitions 11 and 12, the top and bottom slide brackets 32 as associated with each partition are positioned in vertically aligned relationship with respect to one another and both project sidewardly relative to the same side of the partition, with the only difference being that the upper and lower slide brackets are reversely vertically oriented. The upper and lower slide rails are similarly substantially identically positioned vertically one above the other except for their being reversely vertically oriented.

In the illustrated embodiment of the partition assembly, the partitions 11 and 12 have stationary support feet 27 or roller units 26 which extend longitudinally a short distance under the bottom cross beam 19, and in fact extend to a position closely adjacent a side edge of the bottom slide bracket 32. Thus, the slide rail 31 associated with the bottom cross beam 19 is defined solely by a single section having a length corresponding to the top slide rail section 31A, and does not utilize a section equivalent to the top slide rail section 31B. It will be appreciated, however, that the design and configuration of the support feet 27 or roller units 26 may be varied, and in fact would not necessarily have to project under the bottom cross beam 19, and in such situation the slide rail associated with the bottom cross beam could be identical to the top slide rail. Further, in this latter situation, the slide brackets 32 could be mounted on the respective cross beams directly adjacent the upright 17, and hence splitting the side rails 31 into two sections (such as the sections 31A and 31B) would not be required.

Figure 4:
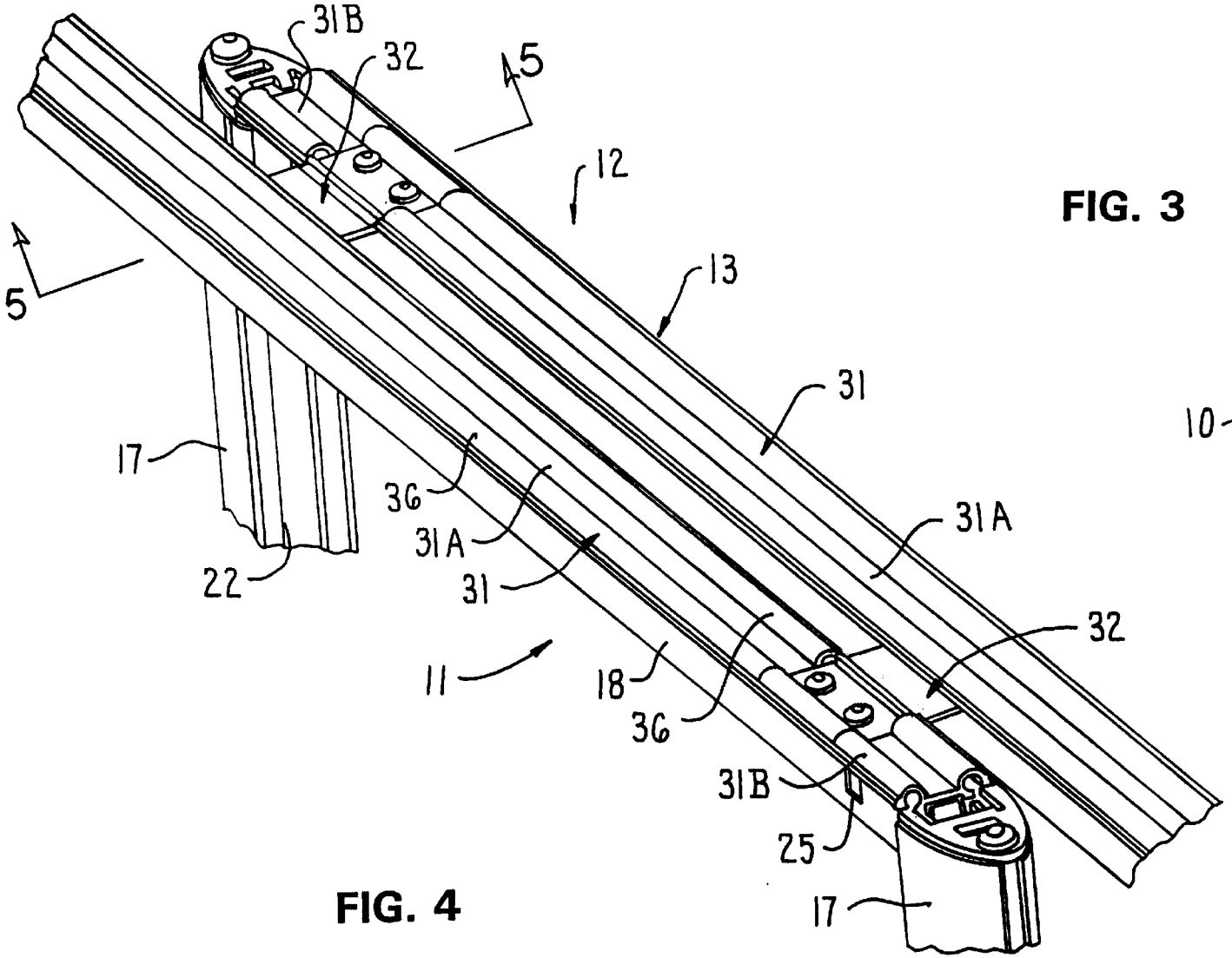
FIG. 4 is an enlarged, fragmentary perspective view illustrating upper portions of the sidewardly adjacent and partially overlapped partition frames and the slide structure which couples them together, the side covers removed from the frames for clarity of illustration.

With the partitions 11 and 12 provided with top and bottom slide rails 31 as well as top and bottom slide brackets 32 as discussed above, the partitions 11 and 12 are thus substantially identical except that the partition 11 is disclosed as having stationary support feet 27, whereas the partition 12 is disclosed as having supporting roller units 26. The partition units 11 and 12 are positioned in sidewardly but horizontally inverted relationship so that the slide brackets 32 disposed adjacent one end of partition 12 are oriented so as to protrude toward the adjacent partition 11, and similarly the slide brackets 32 disposed adjacent one end of the partition 11 are oriented so as to protrude toward an opposed end of the adjacent partition 12. The protrusions on the slide brackets of the partitions 11 and 12 are slidably engaged within the adjacent slide rail channel part of the other partition 12 and 11, respectively, as illustrated in FIG. 4.

To interconnect the partitions 11 and 12, they are each initially provided with the slide rails 31 fixed to the upper and lower horizontal cross beams, thereby leaving appropriate gaps for accommodating the slide brackets 32. Utilizing this gap, the upper and lower slide brackets 32 for one of the partitions (for example the base partition 11) are slidably inserted into the adjacent channel part 36 associated with the slide rail 31 on the other partition 12. This is accomplished by aligning the slide parts 55 with the open ends of the slide rail channel parts adjacent the space or gap in the slide rail on the partition 12, and then slidably inserting the slide parts 55 into the channel parts and moving them longitudinally along the slide rails, while at the same time maintaining the slide brackets 32 disconnected from the partition 11. Thereafter the upper and lower slide brackets 32 for the partition 12 are disposed so that the main mounting parts 51 thereof are seated on and fixedly secured to the respective upper and lower horizontal cross beams 18, 19 of the partition 12, with the brackets 32 being disposed so that the protruding parts 53 project sidewardly toward the opposed adjacent partition 11. The two partitions 11 and 12 are then moved sidewardly toward one another until the protruding slide parts 55 associated with the upper and lower slide brackets 32 fixed to the partition 12 project into the bracket gap which exists along the top and bottom slide rails of the partition 11 and longitudinally aligned with the open end of the adjacent slide rail channel parts 36 associated with partition 11. The partition 12 is then rollingly displaced in its lengthwise direction relative to partition 11 so as to cause the slide parts 55 of the brackets 32 fixed to partition 12 to slidably engage within the adjacent channel parts 36 of the slide rails 31 fixed to the partition 11. Thereafter the pair of upper and lower slide brackets 32 which were previously slidably engaged with the slide rails 31 of partition 12 are slidably moved along the slide rail of partition 12 until the mounting portions 51 of the upper and lower brackets 32 are respectively seated within the bracket-accommodating gaps associated with the upper and lower slide rails of the partition 11. These upper and lower brackets are then fixedly secured by screws or the like to the upper and lower cross beams 18, 19 of the partition 11, thereby completing the slidable connection of the partitions 11 and 12 to one another.

The top caps 28 are then positioned over and resiliently snapped into engagement with the top slide rails 31 of the partitions 11 and 12 substantially as illustrated by FIG. 5, thereby leaving the small access slots 42 which extend horizontally along opposite sides of each partition adjacent but spaced downwardly from the upper edges of the partition, namely directly below the top caps, whereby the only portion of the connecting slide structure which projects from the partition is the small plate-like cantilevered part 53 of the slide bracket, and this part is not only captivated in the small sideward spacing between the adjacent overlapping partitions, but is also spaced vertically downwardly from the upper edges of the partitions so as to be effectively non-visible under ordinary observation conditions.

With the partition assembly 10 joined as discussed above, the one partition 12 can thus be readily rollingly moved relative to the other partition 11 between a closed or non-extended position wherein the partitions 11 and 12 substantially totally sidewardly overlap so that the partition assembly has minimal length, and a substantially fully extended position wherein the partition 12 is rollingly moved lengthwise thereof so that it extends outwardly a substantial distance beyond one end of the partition 11, and the degree of horizontal sideward overlap between the partitions 11 and 12 is thus extremely small, with this fully extended position being limited due to the slide bracket 32 on the partition 11 functioning as a stop in that it contacts the bracket 32 mounted on the moving partition 12 and thus limits the outward extended position of the partition 12. To maximize the degree of extension, the brackets 32 are preferably positioned in close proximity to one of the partition uprights 17.

To provide a positive stopping relationship when the partitions 11 and 12 are in their closed or non-extended position wherein they effectively totally horizontally overlap one another, a suitable stop (not shown) such as a set screw or the like can be provided in the ends of the channel parts 36 of the top slide rails remote from the respective slide bracket 32 so as to prevent any accidental separation between the slide rail on one partition and the slide bracket of the other partition.

When the slide rails 31 and brackets 32 are mounted on the partitions 11, 12 and are engaged with one another, and the top caps 28 are also mounted on the respective slide rails 31, the channel part 63 which extends along one edge of the slide bracket 32 effectively aligns with and hence acts as an extension of the channel part 36 associated with one side of the respectively aligned slide rail 31, and the rib 64 which projects upwardly along the other side of the same slide bracket 32 effectively aligns with the outer leg of the other channel part 36 of the same respective slide rail 31. Thus, when the top cap 28 is engaged on the side rail, the side legs 82 of the top cap 28 project exteriorly downwardly over and effectively engage the exterior sides of the channel part 63 and rib 64 as associated with the respective slide bracket 32.

Further, due to the presence of the pair of generally parallel living hinges defined by the opposed pairs of grooves 61 and 62, the living hinge defined by grooves 61 is effectively disposed adjacent the exterior side of one of the partitions, and the living hinge defined by grooves 62 is effectively defined adjacent the exterior side of the other partition with which the slide bracket is slidably engaged. These generally parallel living hinges defined by grooves 61 and 62, and the fact that they are disposed adjacent and extend substantially parallel with the exterior sides of the joined partitions, thus permit relative flexing and specifically pivoting between the main mounting portion 51 of the slide bracket 32 as secured to one partition and the slide part 55 of the bracket as slidably engaged with the other partition. Accordingly, when partition 12 is moved in an extension direction relative to the base partition 11, the living hinges enable the moving partition 12 to displace either vertically upwardly or downwardly relative to the partition 11 as caused by irregularities in the floor so that the roller units 26 as provided on the moving partition 12 will properly follow and maintain rolling supportive engagement with the floor and avoid imposition of undesired forces on the sliding connecting structure and minimize any tendency for this structure to bind during movement of the partition 12 relative to the partition 11.

The slide rails 31 are preferably constructed of a rigid material, specifically metal, and in the preferred embodiment are formed as aluminum extrusions. The slide brackets 32, on the other hand, are preferably constructed of a plastics material, such as by being molded, and are preferably of a relatively soft and flexible plastics material, such as polypropylene, whereby the properties of this material and the provision of the living hinges as discussed above permit the adjacent partitions 11 and 12 to undergo limited upward or downward vertical displacement and/or slight angular displacement as caused by floor irregularities during rolling movement of the partition 12 while at the same time facilitating relatively free low-friction sliding of the bracket slide parts 55 within the guide channels 36 of the slide rails.

While the frames of the partitions 11 and 12 in the embodiment illustrated by FIGS. 1–9 employ horizontal cross beams formed as hollow metal tubes having a width less than the end upright width so as to permit one or more cover pads to be removably positioned within a recess defined on each side of the panel frame, it will be appreciated that the construction of the panel frame and the type of cover panels associated therewith may assume other configurations and constructions.

Figure 14:
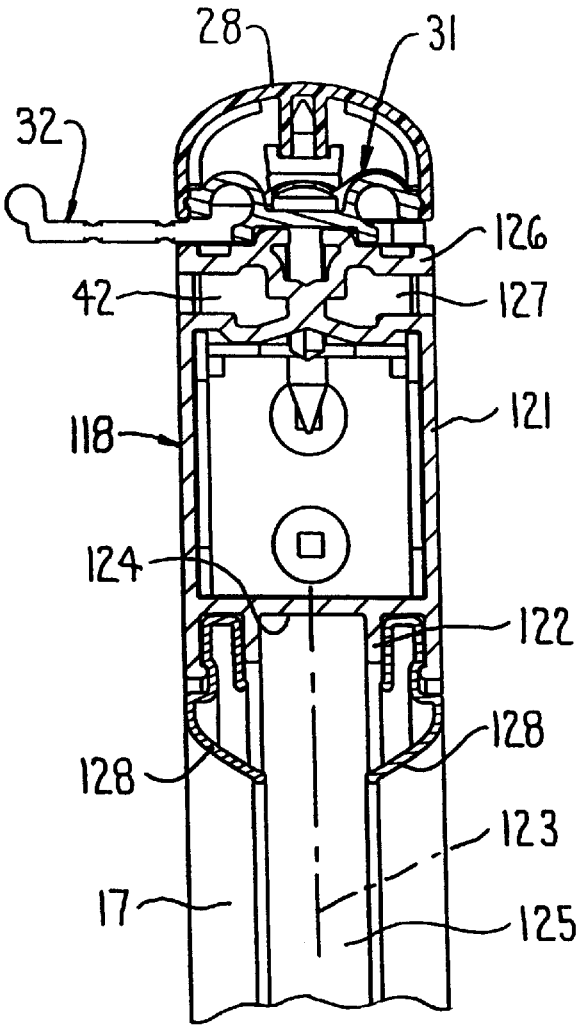
FIGS. 14 and 15 are enlarged fragmentary sectional views of the circled areas designated A and B, respectively, in FIG. 13.
Figure 15:
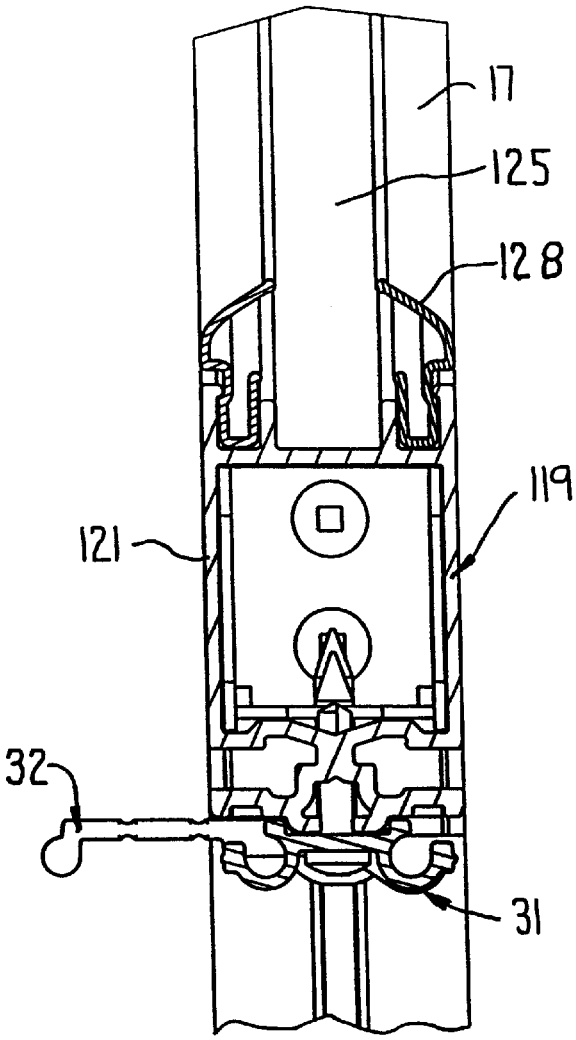
Figure 16:
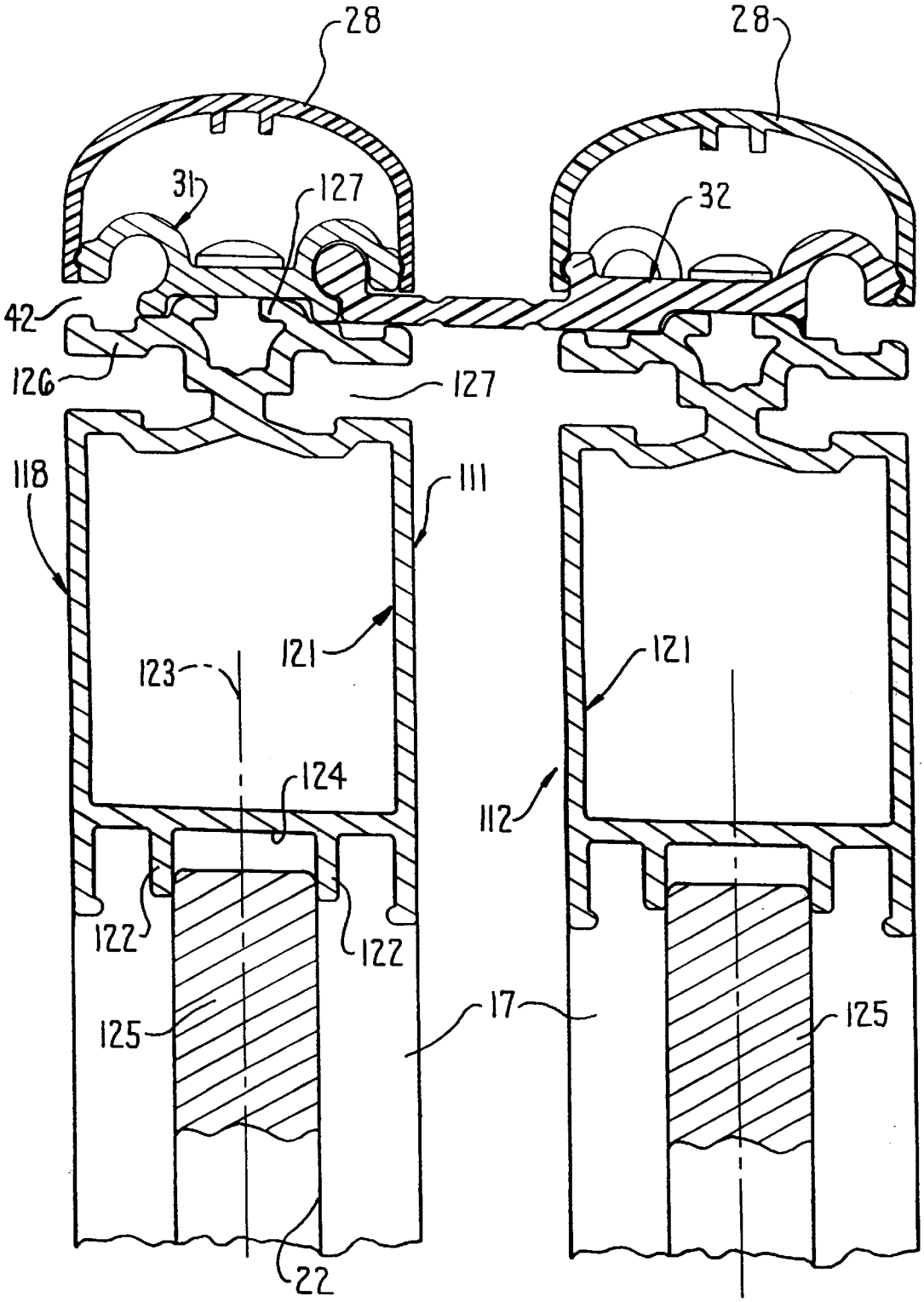
FIG. 16 is an enlarged fragmentary sectional view showing the slidable interconnection adjacent the top edges of partitions having the construction of FIGS. 13–15.

For example, FIGS. 12–16 illustrate a preferred variation of a partition 111 or 112 which can be utilized as a replacement for the partitions of FIG. 1. The partition 111, 112 has a generally rigid rectangular frame defined by the same vertical edge posts or uprights 17 which, adjacent upper and lower ends, are rigidly joined by top and bottom horizontal cross beams 118 and 119. In this variation of the partition, the top cross beam 118 has a cross-section which, as illustrated in FIG. 14, has a width which substantially corresponds to the width of the upright 17 in that it includes a generally rectangular hollow tubular main section 121 having a width which generally corresponds to the width of the upright 17. The top cross beam 118 has a pair of downwardly projecting flanges 122 which are uniformly disposed on opposite sides of the upright center plane 123, thereby defining a downwardly opening channel 124. The bottom cross beam 119 (FIG. 15) is identical to the top cross beam 118 except that it is vertically reversely oriented whereby the channels 124 associated with the top and bottom cross beams are in opposed relationship to one another and thus accommodate therein the upper and lower edges of a panel member 125 (for example a white board) which extends vertically between the upper and lower horizontal cross beams and which also extends horizontally between the uprights 17 so as to effectively close off the interior of the panel frame. Trim or retainer clips 128 extend along the frame elements on both sides of panel 125. With this arrangement, there is provided a panel which is simpler, more economical to manufacture, and of lighter weight.

The top cross beam 118 has a top wall 126 provided with a center portion 127 which is raised upwardly to create a nesting interfitting relationship with the shallow channel defined in the underside of the slide rail 31, and this also nests into the shallow channel formed into the underside of the slide bracket 32 so that the slide rail 31 and slide bracket 32 can thus be fixedly secured to the upper wall of the top cross beam 118 in the same manner as described above with respect to FIGS. 1–11. Further, the bottom cross beam 119 due to its being vertically inverted relative to the top cross beam 118 also permits the slide rail and slide bracket to be mounted thereon in the same inverted relationship.

In this embodiment, the top wall 126 is spaced upwardly from the tubular portion 121 so as to provide slots 127 which open outwardly along opposite sides of the panel in downwardly spaced relation from the narrow access slots 42. These slots 127 are provided so as to permit other components to be secured to and project sidewardly from the partition. It will be appreciated, however, that if such slots 127 are not desired, then the top wall of the tube 121 could be provided with a configuration similar to the top wall 126 so as to permit the slide rail and slide bracket to be mounted directly thereon.

In the variation illustrated by FIGS. 12–16, it will be appreciated that the frame can be provided with one or more intermediate horizontal cross beams if desired, which cross beams would be provided with top and bottom walls configured similar to the bottom wall illustrated in FIG. 14, whereupon plural panel members 125 would thus be provided for extension between the various horizontal cross beams for closing off the interior of the panel frame.

While the extendible partition assembly as described above has been illustrated as employing only two partitions, it will be appreciated that the invention is also applicable to an extendible wall assembly employing more than two (for example three) partitions.

As an example, an assembly employing three partitions can be provided wherein the partition at one end would be a stationary base partition equivalent to the partition 11, an intermediate partition equivalent to the movable partition 12 would be a first movable partition, and a third partition would define a second movable partition and be slidably coupled to the first movable partition 12. In this variation, the first partition (i.e., stationary partition) and the third partition (i.e., second movable partition) would each have a single pair of upper and lower slide brackets disposed adjacent one end of the respective partition and projecting outwardly from one side thereof, and the second partition (i.e., first movable partition) would be sandwiched between the first and third partitions and would have a first pair of upper and lower slide brackets adjacent one end thereof and projecting sidewardly in one direction for engagement with the first partition and would also have a second pair of upper and lower slide brackets which would be disposed adjacent the other end of the second partition and would project sidewardly in the opposite direction for engagement with the third partition. With this variation, and assuming the three partitions in a closed overlapped condition, the third partition could be rollingly extended outwardly relative to the overlapped first and second positions and, when. the third partition reaches its fully extended position, continued manual pulling thereof would then result in the second partition being rollingly extended outwardly relative to the first position, thereby permitting the overall extension of the partition assembly to be significantly increased.

As an alternative to the three-partition arrangement discussed above, it will be appreciated that the middle partition in the three-partition arrangement could be the stationary partition, with the first and third partitions being individually rollingly extendible in opposite directions relative to the intermediate fixed partition.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A horizontally extendible partition arrangement, comprising:

first and second upright partitions provided in sidewardly adjacent and substantially vertical parallel relationship;

a relatively slidable connecting structure joined to said first and second partitions along adjacent upper edges thereof for permitting said first partition to be moved in a lengthwise direction thereof relative to said second partition between a closed position wherein said first and second partitions are disposed in substantial overlapping relationship and an extended position wherein said first partition extends lengthwise beyond and does not significantly overlap said second partition;

said slidable connecting structure including first and second horizontal elongated wall structures fixedly associated with respective said first and second partitions in the vicinity of the upper edges thereof and extending lengthwise of the respective partition, each said wall structure defining a horizontally elongated slot arrangement including a narrow access slot which opens horizontally inwardly from one side of the respective partition in the vicinity of the upper edge thereof and a slide groove which communicates with an inner end of said access slot and projects vertically relative thereto;

said connecting structure also including first and second slide brackets respectively fixed to said first and second partitions adjacent upper edges thereof, said first and second slide brackets each having a cantilevered part which protrudes sidewardly and is slidably engaged within the slot arrangement of the second and first partitions respectively.

2. A partition arrangement according to claim 1, wherein the wall structure as associated with each said partition includes a pair of substantially identical said slot arrangements which extend horizontally lengthwise along the respective partition in the vicinity of the upper edge thereof and which open outwardly through opposite sides of the respective partition.

3. A partition assembly according to claim 2, wherein the wall structure associated with each said partition includes a slide rail which is fixed to and extends horizontally along the respective partition in the vicinity of the upper edge thereof, said slide rail defining a pair of sidewardly-spaced channel parts which define the slide grooves associated with the slot arrangements, and a horizontally elongated removable top cap positioned over and substantially enclosing said slide rail.

4. A partition arrangement according to claim 1, wherein each said slide bracket has a main mounting part which is fixedly secured to the respective partition, said cantilevered part having an intermediate part which extends sidewardly from said main mounting part to said slide part for spanning the gap between said first and second partitions, said intermediate part being flexible to permit at least limited vertical displacement of said first partition relative to said second partition, and said first partition being provided with rollers mounted adjacent lower corners thereof and disposed in supportive rolling engagement with a floor.

5. A partition arrangement according to claim 1, wherein each said partition includes a generally upright rectangular frame having upright end posts rigidly joined by generally horizontal top and bottom cross beams, said wall structure as associated with each said partition including a horizontally-elongated slide rail which is nestingly and fixedly supported on an upper side of said top cross beam and extends lengthwise therealong throughout the length thereof except for a short region within which the respective slide bracket is mounted, said slide rail having a width which substantially corresponds to the width of the partition, said slide rail defining adjacent opposite longitudinally-extending side edges thereof a pair of downwardly opening channel parts which define said slide grooves as defined at inner ends of said slot arrangements.

6. A partition arrangement according to claim 5, wherein the slide bracket is mounted on the upper portion of the top cross beam adjacent an end of the respective slide rail and, at a side thereof remote from the sidewardly protruding cantilevered portion, is provided with a downwardly opening channel portion which is aligned with and effectively constitutes an extension of one of the channel parts associated with the respective slide rail.

7. A partition arrangement according to claim 1, wherein a relatively slidable connecting arrangement is joined to said first and second partitions adjacent lower edges thereof, said slidable connecting arrangement being substantially identical to said slidable connecting structure but being reversely vertically oriented.

8. A horizontally extendible partition arrangement, comprising:

first and second upright partitions disposed in sidewardly closely adjacent and substantially vertical parallel relationship, said first partition having supports adjacent lower corners thereof for supporting engagement with a floor, and said second partition having roller units adjacent lower corners thereof for rolling supportive engagement with a floor so that said second partition can be linearly moved in the lengthwise direction thereof;

top and bottom slidable connecting structures joined between said first and second partitions adjacent respective upper and lower edges thereof for permitting said second partition to be rollingly moved between a first position wherein it substantially entirely vertically overlaps said first partition and a second position wherein said second partition extends lengthwise significantly beyond the first partition so that the first and second partitions do not significantly vertically overlap;

said top and bottom connecting structures including horizontally elongated top and bottom slide rails fixedly secured to each of said partitions and extending horizontally therealong throughout a majority of the lengthwise extent thereof adjacent the respective upper and lower edges of the partition, the upper and lower slide rails being reversely oriented and each including a pair of generally parallel channel parts which extend horizontally lengthwise of the respective slide rail and are disposed adjacent opposite side edges thereof so as to be disposed adjacent opposite sides of the respective partition, the channel parts associated with each said slide rail defining therein a vertically-opening slide groove; and said top and bottom connecting structures also including top and bottom slide brackets fixedly secured to each said partition adjacent one end of the respective top and bottom slide rails, said slide brackets each including a sidewardly protruding cantilevered portion which projects horizontally between the sidewardly adjacent partitions and which adjacent an outer free end is provided with a vertically protruding slide part which is slidably engaged within one of the channel parts provided on the slide rail of the sidewardly adjacent partition, the top and bottom slide brackets as associated with each said partition being substantially identical but reversely vertically oriented, whereby the upper and lower brackets as fixedly mounted on each of said first and second partitions are slidably engaged with the upper and lower slide rails which are provided on the second and first partitions respectively.

9. A partition arrangement according to claim 8, wherein the channel parts as defined on the slide rails are disposed in vertically opposed but vertically spaced relationship from a wall structure associated with the respective partition so as to define a generally L-shaped slot arrangement therebetween which includes a generally horizontally extending access slot which at one end opens horizontally outwardly through a side surface of the partition and which at an inner end communicates with the vertically oriented slide groove defined by the respective channel part, whereby the cantilevered portion of the slide bracket when engaged within the slot is sidewardly captivated.

10. A partition arrangement according to claim 9, wherein the cantilevered portion of the slide bracket, in an intermediate portion thereof which spans between the sidewardly adjacent partitions, is flexible to permit relative vertical movement between the adjacent first and second partitions.

11. A partition arrangement according to claim 10, wherein the flexibility in the intermediate portion of the slide bracket is defined by a living hinge arrangement which extends substantially horizontally in a direction generally parallel with the lengthwise extent of the partitions.

12. A partition arrangement according to claim 10, wherein each said partition includes a horizontally elongate top cap which extends horizontally along and defines the upper edge of the respective partition, said top cap being positioned above the top slide rail and removably supported thereon, said top cap having side legs which project downwardly so as to substantially sidewardly enclose the top slide rail.

13. A partition arrangement according to claim 8, wherein the cantilevered portion of the slide bracket, in an intermediate portion thereof which spans between the sidewardly adjacent partitions, is flexible to permit relative vertical movement between the adjacent first and second partitions.

14. A partition arrangement according to claim 8 wherein each said partition includes a horizontally elongate top cap which extends horizontally along and defines the upper edge of the respective partition, said top cap being positioned above the top slide rail and removably supported thereon, said top cap having side legs which project downwardly so as to substantially sidewardly enclose the top slide rail.

* * * * *